United States Patent [19]

Davidsson

[11] Patent Number: 4,846,582

[45] Date of Patent: Jul. 11, 1989

[54] POLYMER DISSOLVER

[75] Inventor: Jan O. P. Davidsson, Malmö, Sweden

[73] Assignee: Boliden Aktienbolag, Stockholm, Sweden

[21] Appl. No.: 847,254

[22] Filed: Apr. 2, 1986

[30] Foreign Application Priority Data

Apr. 16, 1985 [SE] Sweden ..... 8501854

[51] Int. Cl.[4] ..... B01F 1/00; B01F 15/02

[52] U.S. Cl. ..... 366/150; 366/181; 422/255; 433/901

[58] Field of Search ..... 366/150, 156, 167, 168, 366/174, 181; 422/255, 261, 278, 901; 239/314, 336, 379, 426, 509

[56] References Cited

U.S. PATENT DOCUMENTS

| | | | |
|---|---|---|---|
| 2,126,911 | 8/1938 | Mullen | 366/137 X |
| 2,453,465 | 11/1948 | Sloan | 366/167 X |
| 2,785,455 | 3/1957 | McElroy | 366/167 X |
| 3,164,443 | 1/1965 | Watson | 422/901 X |
| 3,201,093 | 8/1965 | Smith | 366/167 X |
| 3,879,021 | 4/1975 | Riley | 366/174 X |
| 3,995,839 | 12/1976 | Zingg | 366/167 X |
| 4,100,614 | 7/1978 | Mandt | 366/167 X |
| 4,112,517 | 9/1978 | Giombini | 366/168 X |
| 4,191,480 | 3/1980 | Hiorth | 366/336 |
| 4,594,005 | 6/1986 | Sakamoto et al. | 366/177 |

FOREIGN PATENT DOCUMENTS

| | | |
|---|---|---|
| 1237537 | 3/1967 | Fed. Rep. of Germany . |
| 450366 | 4/1968 | Switzerland . |

*Primary Examiner*—Harvey C. Hornsby
*Assistant Examiner*—Scott J. Haugland
*Attorney, Agent, or Firm*—Burns, Doane, Swecker & Mathis

[57] ABSTRACT

The present invention relates to a method for dissolving a solid polymer in a solvent, in which the polymer in a fine-particulate state is introduced into a jet of solvent at substantially right angles thereto, such that the polymer particles are captured by the jet; whereafter the jet of solvent and captured polymer is projected forcibly against a surface which is inclined to the major directional component of the jet, such as to cause the jet to change direction and break-up into discrete droplets.

18 Claims, 1 Drawing Sheet

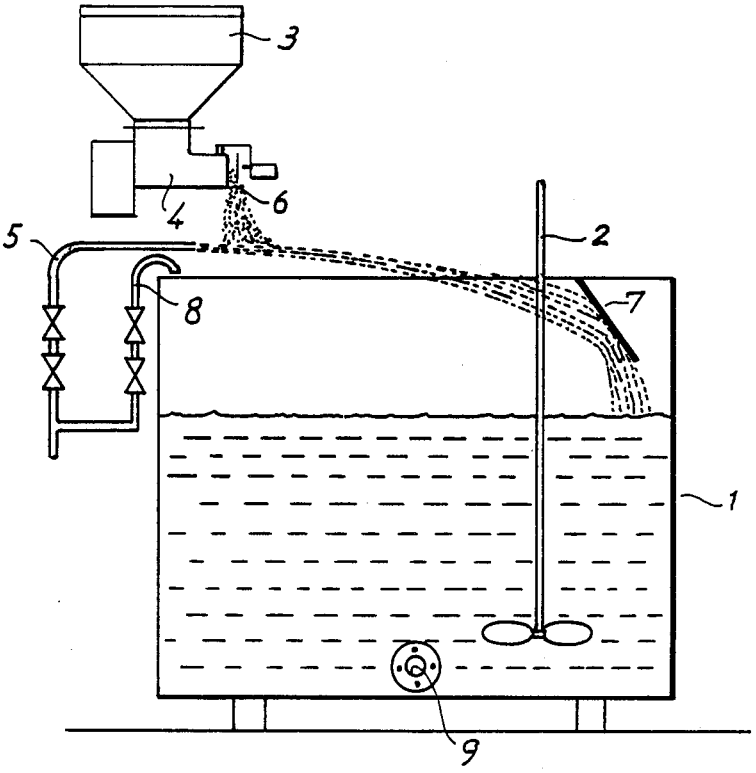
3
4
6
5
2
8
7
1
9

POLYMER DISSOLVER

TECHNICAL FIELD

The present invention relates to a method and apparatus for dissolving solid polymers.

The object of the present invention is to provide ways and means by which a water-soluble polymer can be dissolved rapidly in water or an aqueous solution, to provide a solution of polymeric flocculating agent, or a solution of polymers for further reaction by addition of further components.

BACKGROUND PRIOR ART

It is known to dissolve solid polymers in water, by finely dividing the solid polymer and introducing it into water while agitating the water bath. It has been found, however, that some polymers such as polyethylene oxide, used in the cellulose industry as an auxiliary flocculating agent, take a very long time to dissolve, which presents a problem to the achievement of rational procedures.

Consequently, there is a need for a method or an apparatus with which the time taken to dissolve not-readily dissolved polymers can be shortened to one tenth or less of the time taken at present.

DISCLOSURE OF THE PRESENT INVENTION

It has surprisingly now been found possible to satisfy this need by means of the present invention, which is characterized by bringing the solid polymer in a finely particulated state into contact with a jet of dissolving agent at substantially right angles thereto such that the polymer is captured by said jet; and by subsequently projecting the jet of solvent and captured polymer forcibly onto an oblique surface such as to cause the jet to change direction and to break-up.

Further characteristic features of the invention are set forth in applicable claims.

By polymer is meant here and in the following organic polymers such as polyethylene oxides, in particular those of high molecular weight polymers, and polyacrylamide, although not-readily solvable inorganic salts, such as polyaluminum hydroxide-complexes of the chloride and sulphate type are also included. In the present context, the word "polymer" is also meant to include starch and starch derivatives.

The jet of solvent—which is in the main a jet of water—together with the polymer is preferably inclined to a plane which extends substantially at right angles to the oblique surface, such that it impinges on the oblique surface at an angle of 30°-60° thereto, preferably 30°-45°.

Subsequent to the jet having struck against the oblique surface and breaking-up as a result thereof, the droplets of solvent-polymer are thrown down against an agitated collecting-dissolving body of solvent.

BRIEF DESCRIPTION OF THE DRAWING

The invention will now be described in more detail with reference to the accompanying drawing, the sole FIGURE of which illustrates schematically and in cross-section an apparatus for carrying out the method according to the invention.

DESCRIPTION OF A PREFERRED EMBODIMENT

The reference 1 identifies a cylindrical container, which is provided with a stirrer or agitator 2. Arranged above the container 1 is a supply hopper 3 which is intended to receive solid polymeric material in finely particulated form and to which there is connected a feed screw 4. The exit orifice 6 of the screw 4 is located at a short distance from the top of the container 1. Arranged on one side of the container 1 is a horizontal water-supply pipe 5 which is aligned with a point vertically beneath the exit orifice 6 of the feed screw 4. An inclined plate 7 is located immediately beneath the upper edge of the container 1, in the geometric extension of the pipe 5 through the aforesaid point. A plane extending substantially at right angles to the plate 7 falls through said point and the geometric extension of the water-supply pipe 5. The container 1 is also equipped with a water-intake 8 and an outlet 9 through which the finished product is removed.

In preparing a polymer solution the hopper 3 is filled with a relevant, finely particulated polymer, such as a polyethylene oxide, the polymer particles measure roughly between 0.2 and 1 mm in diameter. The container 1 is filled to a third of its volumetric capacity with water, entering through the water-intake 8, whereafter the agitator or stirrer 2 is set into motion. Water is then ejected through the pipe 5 towards the plate 7 at a force which ensures that it strikes the obliquely positioned plate. Subsequent to trimming the water jet issuing from the pipe 5, so that the jet strikes the plate 7 in the manner intended, the solid polymer is fed down over the water jet by the feed screw 4, so that individual polymer particles are captured by the jet and carried against the obliquely positioned plate 7. As the jet of water and particulate polymer strikes the plate 7, it is initially deflected downwards, and then breaks-up into a large number of droplets, which are thrown obliquely down into the underlying container.

Thus, as a result of this procedure, each polymer particle is thoroughly wetted and separated from each other particle, or at least substantially from each other polymer particle, and brought down into the underlying aqueous solution, in which the discrete polymer particles rapidly dissolve, as experiments have shown to be the case.

The water and polymer are dispensed in quantities adapted to provide a polymer concentration suitable for the field of application in question, normally 0.01-5% by volume, more often 1-4% by volume.

I claim:

1. A method for dissolving a solid polymeric flocculating agent in a solvent comprising:

(a) introducing a stream of finely particulate polymeric flocculating agent into a jet of solvent flowing at a substantially right angle thereto so that polymer particles are captured by the jet of solvent; and (b) projecting the jet of solvent and captured polymer particles against a surface which is inclined to the major directional component of the jet of solvent and captured polymer particles so as to cause the jet of solvent and captured polymer particles to be deflected downwards and break-up into a large number of droplets.

2. The method of claim 1 wherein the jet of solvent is horizontally directed and the finely particulate polymeric flocculating agent falls freely toward the horizontally directed jet of solvent.

3. The method of claim 2 wherein the jet of solvent has air mixed therein to effect a primary division of the jet of solvent into discrete droplets.

4. The method of claim 3 wherein the polymeric flocculating agent is polyethylene oxide.

5. The method of claim 3 wherein the polymeric flocculating agent is polyacrylamide.

6. The method of claim 3 wherein the surface is inclined to the major directional component of the jet of solvent at an angle in the range of from 30 to 60 degrees.

7. The method of claim 6 wherein the angle is in the range of 30 to 45 degrees.

8. The method of claim 3 wherein the polymer particles have a diameter in the range of from about 0.2 and about 1 mm.

9. The method of claim 3 wherein the concentration of polymeric flocculating agent in the solution formed by the method is from 0.01 to 5% by volume.

10. The method of claim 9 wherein the concentration of polymeric flocculating agent in the solvent is from 1 to 4% by volume.

11. The method of claim 1 wherein the jet of solvent has air mixed therein to effect a primary division of the jet of solvent into discrete droplets.

12. An apparatus for dissolving solid polymeric flocculating agent in a solvent comprising:

(a) a source of finely particulate polymeric flocculating agent;

(b) means for feeding a stream of finely particulate polymeric flocculating agent from the source thereof in a downward direction;

(c) a source of solvent;

(d) jet means connected to the source of solvent, said jet means directing a jet of solvent at a substantially right angle to the stream of finely particulate polymeric flocculating agent so that polymer particles are captured by the jet of solvent; and (e) deflector means located in the path of the jet of solvent and captured polymer particles and having a surface which is inclined to the major directional component of the jet of solvent and captured polymer particle so as to cause the jet of solvent and captured polymer particles to be deflected downwards and break-up into a large number of droplets.

13. The apparatus of claim 12 wherein the surface is inclined to the major directional component of the jet of solvent at an angle in the range of from 30 to 60 degrees.

14. The apparatus of claim 13 wherein the angle is in the range of 30 to 45 degrees.

15. The apparatus of claim 12 wherein the means for feeding a stream of finely particulate polymeric flocculating agent in a downward direction is a screw feeder.

16. The apparatus of claim 12 further including means for collecting the dissolved polymeric flocculating agent.

17. The apparatus of claim 16 wherein the means for collecting the dissolved polymeric flocculating agent includes means for agitating the dissolved polymeric flocculating agent.

18. The apparatus of claim 12 wherein the jet means is arranged to direct the jet of solvent in a horizontal direction.

* * * * *